United States Patent [19]

Johnson

[11] 4,021,928

[45] May 10, 1977

[54] CROSS-FLOW MODULAR TOBACCO CURING SYSTEM

[75] Inventor: William Hugh Johnson, Raleigh, N.C.

[73] Assignee: Research Corporation, New York, N.Y.

[22] Filed: Nov. 25, 1975

[21] Appl. No.: 635,085

Related U.S. Application Data

[63] Continuation-in-part of Ser. No. 425,848, Dec. 18, 1973, Pat. No. 3,932,946, which is a continuation of Ser. No. 288,028, Sept. 11, 1972, abandoned.

[52] U.S. Cl. ..... 34/38; 34/201; 34/236; 131/134; 432/500

[51] Int. Cl.[2] ..... F26B 3/00; F26B 25/06

[58] Field of Search ..... 34/38, 201, 219, 236; 432/500; 220/1.5; 131/134

[56] References Cited

UNITED STATES PATENTS

| | | | |
|---|---|---|---|
| 3,231,986 | 2/1966 | Touton | 34/219 |
| 3,866,334 | 2/1975 | Huang | 34/219 |
| 3,935,648 | 2/1976 | Cox | 432/500 X |
| 3,935,959 | 2/1976 | Long | 432/500 X |

*Primary Examiner*—John J. Camby
*Attorney, Agent, or Firm*—Harold L. Stowell

[57] ABSTRACT

A curing module is provided of generally rectangular solid configuration of which the bottom is imperforate and includes runners to facilitate lifting by fork lift; the top is imperforate with means for minimizing air leakage between the tobacco and top inner surface; the rear wall is imperforate with horizontal ledges to support the ends of tines which penetrate the tobacco; the front is generally imperforate, but opens to facilitate loading and when closed enables insertion of sharp rods which penetrate the tobacco and provide vertical support; and two opposed perforate side walls which permit horizontal cross-flow of the curing gas. One wall of which may be hinged to permit mechanized unloading of the cured leaf. Also provided is a simplified curing structure to receive the modules which are stacked by conventional fork lift equipment and to direct curing air horizontally through the perforate sides of the modules at controlled temperature, himidity and velocity.

4 Claims, 10 Drawing Figures

CROSS-FLOW MODULAR TOBACCO CURING SYSTEM

CROSS-REFERENCE TO RELATED APPLICATIONS

This application is a continuation-in-part of application Ser. No. 425,848 filed Dec. 18, 1973, now U.S. Pat. No. 3,932,946, which is a continuation of application Ser. No. 288,028 filed Sept. 11, 1972 (now abandoned). Related subject matter is disclosed in application Ser. No. 388,590 (now U.S. Pat. No. 3,899,836) which is a continuation-in-part of said application Ser. No. 288,028, now abandoned and still further related subject matter is disclosed in my U.S. Pat. No. 3,885,376.

BACKGROUND OF THE INVENTION

Historically, the harvesting and curing of tobacco has presented the greatest bottleneck to efficient, economical production. Tobacco leaves were hand harvested over a 5 to 8 week period and the leaves strung on sticks which were placed on tiers in curing barns 16 to 24 feet high. Labor requirements for harvest through curing were in the range of 180 to 220 man-hours per acre. Mechanical harvesting and bulk curing systems introduced during the 1960's reduced these requirements to about 50 man-hours per acre.

The advent of mechanical harvesting introduced a new problem, however, from a material handling viewpoint. A machine is capable of harvesting up to 12 to 15 tons of material per day. This meant that hand racking of tobacco at the barn now became the bottleneck to further gains in efficiency. Recognizing this fact in my previous applications. Ser. No. 288,028;, now abandoned, Ser. No. 425,848, now U.S. Pat. No. 3,932,946, No. 388,590, now U.S. Pat. No. 3,899,836 a modular tobacco handling and curing system is described, wherein large containers are positioned onto a special plenum for curing and air is forced upwardly or downwardly through the containers.

My research has indicated certain limitations to the current approaches, particularly in regard to achieving maximum economy in the handling and curing system. With large containers, tobacco is inherently packed to a higher density than in the normal racks and barn capacity is increased. With the small racks, the average density of tobacco in the curing space is 6 to 8 pounds/ft$^3$; whereas, with the large containers, the average density may be 14 to 18 pounds/ft$^3$. For timely curing and to achieve high quality, it is necessary that static pressures in the inlet plenum be increased to move air at the required rate through the more dense tobacco. Furthermore, since the drying front moves progressively from the inlet to outlet, increasing this distance through which the air must be forced has the effect of increasing power requirements for the fan and increasing the length of the drying period, factors which are contrary to the goal of improving curing efficiency. Another very important factor is that the tobacco within the container near the exit side is subjected to near saturated air conditions throughout the yellowing phase and for some time into the drying phase until a considerable portion of water in the tobacco has been removed from leaves near the inlet side. While this may be satisfactory for many leaf conditions, a number of conditions have been noted in which leaf deterioration can rapidly occur. Under certain field conditions, depending upon weather, soil moisture and temperature, soil pathogens, (particularly Erwinia) can develop rapidly and be splashed onto lower leaves of the plant. During curing, at high humidities, infected leaves can develop soft rot and rapidly deteriorate both midrib and laminar portions of the leaf. During the past two years, several cases of soft rot have been observed to occur in large curing containers where tobacco was infected by leaf rotting pathogens, with losses up to 50%. It appears evident, that there are strict limitations to the practical distances through which the air passes through tobacco in large containers.

SUMMARY OF THE PRESENT INVENTION

The present invention relates to a new curing module design and curing system which greatly increases the efficiency of handling and curing tobacco, improves cured leaf quality, facilitates mechanized load-out in preparing cured leaf for market, and substantially reduces curing equipment cost per pound of cured leaf. These advantages are accomplished by providing a curing module design which provides for horizontal, cross-flow air movement through the modules with practical levels of tobacco resistance to airflow, fork lift handling and stacking of curing modules to increase capacity within a curing structure, and side-unloading capability. The cross-flow curing modules are moved easily into the curing facility by fork-lift equipment and, by the arrangement of stacking, forms a high pressure plenum on one side of the modules which permits effective air movement through the tightly packed tobacco while providing greatly increased curing capacity per square foot of floor area. Furthermore, the module design with side unloading feature permits rapid, mechanized unloading for market preparation. Unlike existing bulk curing systems, which necessitate increased static pressures for the inlet plenum as height of curing container is increased, this system permits the establishment of a fixed static pressure as height of the column of material to be cured is increased.

Prior attempts have been made to provide cross-flow treating and drying facilities as exemplified by U.S. Pat. Nos. 1,393,086; 2,105,848 and 3,359,989. However, in such prior art structures, no consideration was given to leaf orientation relative to direction of air movement, leaf density or leaf support during the treatment process. It is only when these factors are combined with cross-flow are the advantages of this invention fully realized.

OBJECTS OF THE PRESENT INVENTION

To provide a mechanized handling, curing and unloading system which enables direct placement of tobacco into curing modules holding 1000 pounds or more of tobacco.

To provide a curing module of simplified design and construction which reduces equipment cost per pound of cured material and which permits cross-flow circulation of the curing air with dimensions such that air flow resistance is maintained within nominal levels and fan efficiency is high.

To provide a curing module which enables establishing of yellowing and drying conditions which minimize the development of leaf deterioration by soft-rot pathogens, and which permits timely removal of moisture and reduced curing time over existing bulk systems.

To provide a curing module which supports the tobacco by horizontal tines or rods which penetrate the tobacco perpendicular to the general plane of tobacco leaves and which permits horizontal passage of forced, conditioned air through the tobacco such that yellowing, drying, and conditioning phases of curing are performed with high reliability and uniformity of cured leaf product.

To provide a modular curing system which receives the above cross-flow modules and which provides conditioned airflow for complete curing and post-curing conditioning of the leaf.

To provide a modular curing system which enables by insertion of the above cross-flow modules the formation of a vertical, high-pressure inlet plenum for effective air movement through the tobacco during curing and reduces heat losses from the curing system.

To provide a modular curing system which reduces the overall equipment investment per pound of cured output in comparison with existing or modified bulk curing units.

These and other objects and advantages will become apparent to those skilled in the art from the following discussion of the invention in detail.

DESCRIPTION OF THE PREFERRED EMBODIMENTS

Figure 1:
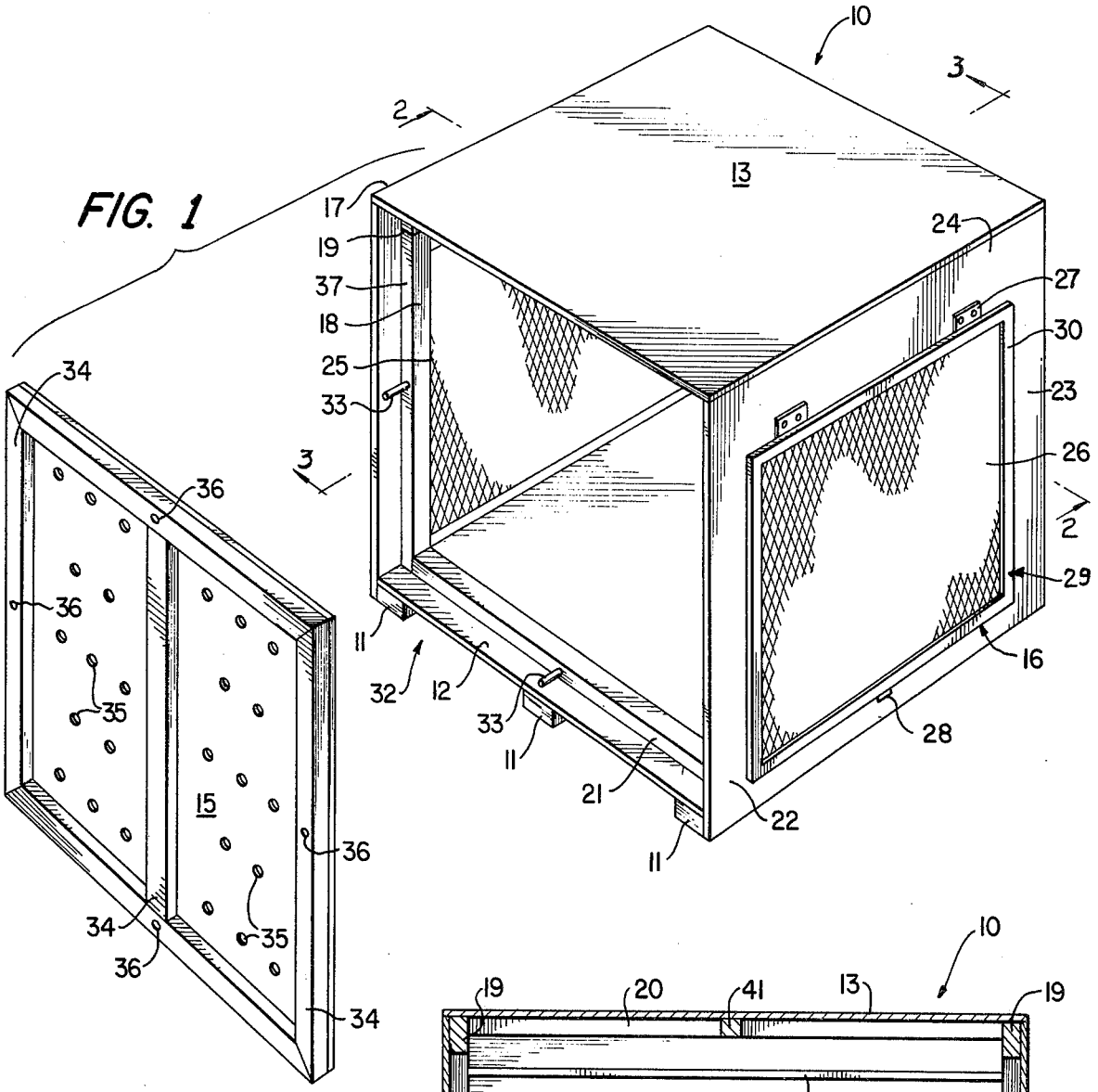
FIG. 1 is a perspective view of a preferred form of the cross-flow curing module of the invention.
Figure 2:
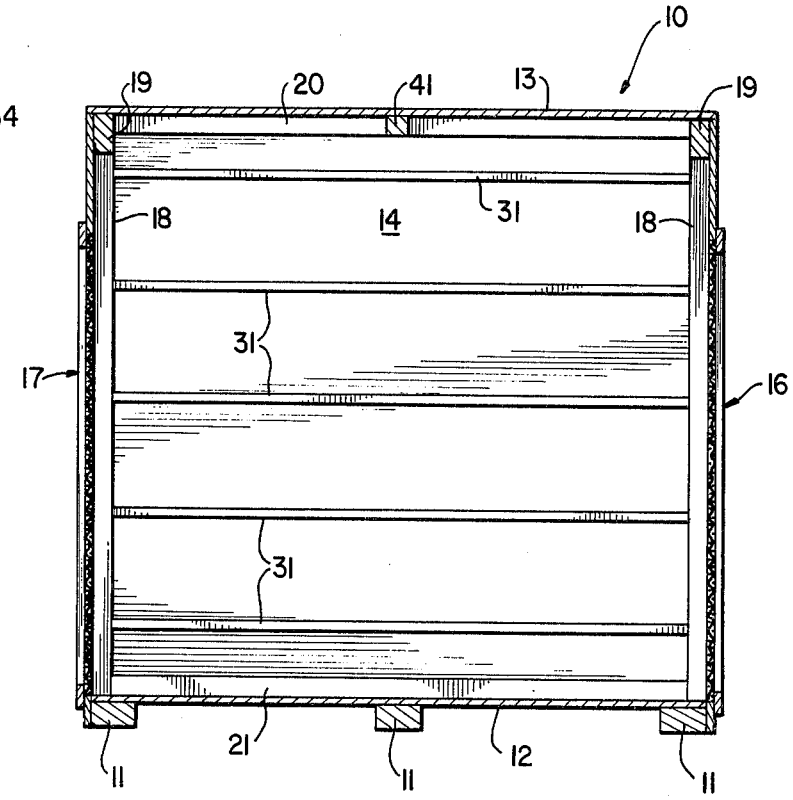
FIG. 2 is a sectional view on the line 2—2 of FIG. 1 and illustrating the interior ledge supports of the rear wall of the curing module.
Figure 3:
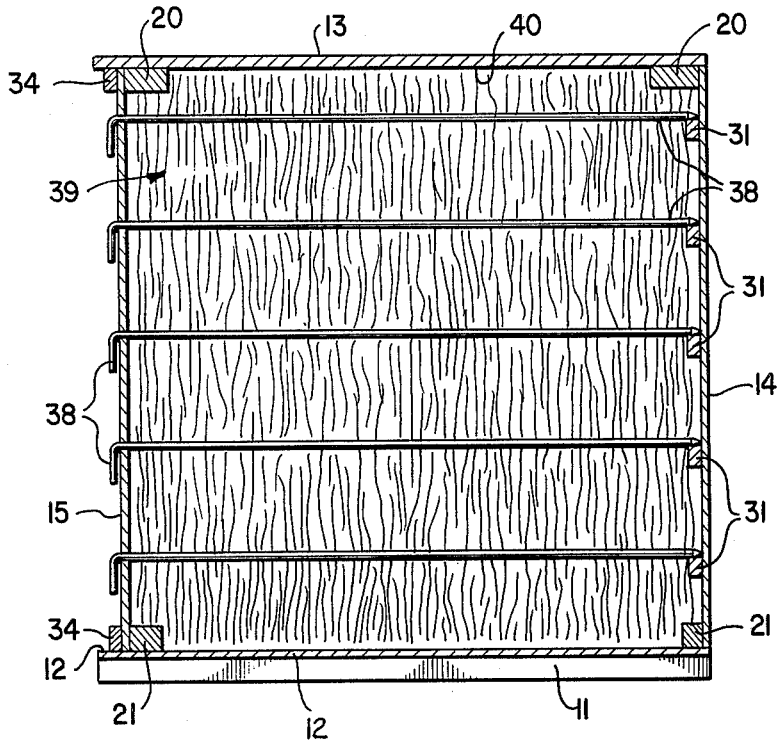
FIG. 3 is a sectional view on the line 3—3 of FIG. 1 and illustrating leaf support by tines which penetrate the leaves generally perpendicular to their plane of orientation.

Referring to FIGS. 1–3, specific details of construction of the improved module are illustrated. While numerous types of materials could be utilized for construction of the module, such as sheet steel, angle iron, etc., preferable materials are lumber, plywood, and expanded metal for economy, light weight and ease of construction. Module dimensions may vary considerably in terms of width, length and height; however, greatest economy is realized in the use of 4 × 8 feet plywood sheets when the module is approximately 4 feet cube. Furthermore, a container of this size is almost ideal from the standpoint of fork-lift handling and stacking. The module 10 includes an imperforate bottom 12 mounted to runners 11; as imperforate top wall 13; generally imperforate rear wall 14; and essentially imperforate front door 15, and two perforate side walls 16 and 17. In the illustrated form of the invention the module 10 is essentially cubical in configuration, and a module of 4 × 4 × 4 feet outside dimensions is designed to hold from about 900 to about 1300 pounds of uncured tobacco, with an empty container weight of about 175 to 200 pounds.

The runners 11 and imperforate bottom 12 provide a durable base which facilitates fork-lift handling. The runners 11 are preferably of 2 × 4 inch or 4 × 4 inch oak or pine members for durability and strength. The imperforate bottom 12 is preferably of exterior grade plywood of such thickness as to withstand heavy loads of stacked modules up to 12 to 20 feet high. A ⅝inch plywood (group 1) sheet on three runners will support stacked modules to 20 feet high. The bottom plywood sheet 12 may be secured to the runners 11 with coated nails, wood screws, etc. to form a base upon which the remainder of the module is constructed.

The structural framework to which the plywood sides are attached consists of interior framing of 2×4 inches or 2 × 2 inch wood members. While exterior framing and braces could conceivably be used, interior framing provides greater interior volume for specified external dimensions and better exterior surfaces for obtaining an effective air seal between modules. Four corner posts 18 are preferably of 2 × 4 inch size, which rest directly on the bottom 12. Top structural side members 19 are preferably of 2 × 4 inch size and are turned edgewise to rest on the top ends of the corner posts 18. Front and rear top structural members 20 are also of 2 × 4 inch size but laid flat, and connected with an end lap joint to the side members 19. Front and rear bottom structural members 21 are of 2 × 2 inch size and are simple butt jointed to the corner posts 18.

The perforate side walls 16 and 17 permit a horizontal, cross-flow of conditioned air through the tobacco during curing. The peripheral portion of plywood, being imperforate, serves to reduce excessive leakage of air along the front, top and rear walls. For the front portion 22 and rear portion 23 of the side wall 16, widths of 3 to 5 inches for the imperforate part of the wall has been found advantageous. For the top portion 24, an 8 to 10 - inch imperforate baffle is more suitable, since tobacco tends to settle away from the top wall 13 by gravity as drying proceeds. Construction of the two perforate walls 16 and 17 is almost identical, except the perforate screen 25 of side wall 17 is shown fixed, whereas the perforate screen 26 of wall 16 is shown hinged at the top 27 with a latch 28 to secure the screen. The hinged side screen door 29 permits mechanical dumping of the cured leaf with a fork-lift equipped with a load inverter designed to clamp the module at the top and bottom.

The imperforate portion of side walls 16 and 17 is secured to the structural framework of the module by wood screws, nails or the like. The perforate screen portions 25, 26 may be easily fabricated from expanded metal welded into an angle iron frame 30. For the fixed perforate screen 25, wood screws should be used to attach the frame 30 to the plywood. Butt hinges 27 are preferably welded to the angle frame 30, then the hinge connected with screws to the plywood panel 24.

The imperforate rear wall 14 is constructed also of plywood of ½ or ⅝ inch exterior grade. The wall panel is cut to fit inside the side and top wall plywood panels, as shown, and to rest directly on the bottom 12. This panel may be secured by nails, etc. to the interior framework members 18, 19, 20 and 21. Provided also on the inner surface of the rear wall 14 are several horizontal ledges 31, FIG. 3 which may be spaced from 6 to 8 inches apart. These ledges, as will be described later, serve to support the ends of rods or tines which in turn provide vertical support for the tobacco during curing. The ledges 31 may consist of 1 × 2 inch furring strips, 1½ ×1½ inch angle iron, etc. secured firmly to the rear wall 14.

The front generally imperforate door 15, as shown in FIG. 1 is recessed within the opening 32, is removable and is attached by means of wood bolts 33. While this door may be hinged, it appears preferable to simply remove the door as needed, since hinge mounts would receive considerable strain immediately after filling the module and sealing could pose a problem. The door 15 is constructed preferably of ½ or ⅝ inch exterior plywood and is reinforced by wood furring strips 34 along the periphery and center. A number of holes 35 of about ½ inch diameter are provided in the plywood sheet to enable insertion of sharpened rods 38, FIG. 3, which penetrate the tobacco after the module is filled. The holes are spaced preferably in rows at about 6 to 10-inch intervals, with holes staggered relative to holes in adjacent rows. The sharpened rods 38 should be slightly smaller in diameter than the hole diameter, to permit insertion but to minimize air leakage through the holes 35.

During filling, the module 10 is oriented such that the opening for the door 15 is at the top. Tobacco leaves, cut-strip tobacco, or chopped material may be conveyed directly into the module and through distribution equipment as described in my previous U.S. Pat. No. 3,885,376. Also hand harvested leaves (or complete tobacco plants) may be packed by hand directly into the module. At this point, the door is installed, and connected by means of wood bolts 33 which pass through the holes 36, and appropriate nuts installed. A gasket may be provided on the face 37 of the construction members of the module to assure minimal air leakage from inside to outside the container.

Insertion of the rods or tines 38 and rotation of the container are accomplished after the door 15 is secured to the module 10. The module 10 may either have the door 15 at the top or be rotated 90° to the orientation of FIG. 1 for insertion of the rods. Insertion of rods after rotation is permissible only if the tobacco is sufficiently firm within the container such that it does not tend to settle away from top wall 13 during rotation. The rods penetrate the door, pass through the tobacco within the container and are supported on the rear wall ledges 31 as previously described.

Referring now to FIG. 3 showing a sectional view of the curing module and illustrating the tine support of tobacco, rods 38 pass through the door 15, through the tobacco 39 and rest on the ledges 31 on the rear wall 14. As noted in this Figure, the tobacco is now oriented generally vertical with the general plane of the leaves perpendicular to the perforate side walls. Hence air can be forced with relative ease through the perforate side walls and the tobacco. As pointed out earlier, as drying proceeds there is always the tendency for air leakage along side walls as the tobacco shrinks. This can be overcome to a great extent by the described design of the imperforate portion of the side walls 16 and 17. Since shrinkage and gravity both tend to cause separation of tobacco from the top wall 13 inner surface 40, longitudinal top strips 41, are used advantageously to help block leakage along the top wall. Other means for reducing this leakage include gravity baffle strips mounted similar to strips 41 or flexible strips of canvas, plastic, rubber, etc. which are attached to the perforate side walls such that the air pressure maintains the strips in contact with the tobacco.

The above discussion pertains essentially to the improved features and fabrication of the curing module, and to cross-flow characteristics which can be achieved with this module. It will be readily apparent to one skilled in the art of harvest and curing of tobacco that the cross-flow curing module lends itself to various mechanized or hand harvest schemes. For example, with mechanical harvesting two modules can be positioned side by side with the open front door side oriented upwardly on the rear of the machine to receive the defoliated tobacco. Current mechanical harvesters have two forks which lift a trailer on the rear of the machine. A preferred arrangement with the cross-flow modules of 4 feet cube size is to provide four forks which simply lift two empty modules from the bed of a transport truck or trailer. The bed on the truck should be provided with cross members on which the modules are carried to permit insertion of the harvester forks beneath the rear wall 14 of the module. An additional man on the rear deck of the harvester can assist in distributing tobacco into the modules and assure proper filling of corners, or a mechanical distributor can be provided. After filling, the modules are lowered to the transport truck or trailer, taken to the barn and there lifted by fork lift from the transport unit. Operations of installing the door, insertions of rods and rotating 90° remain to be completed before the module is positioned into the curing barn.

Figure 4:
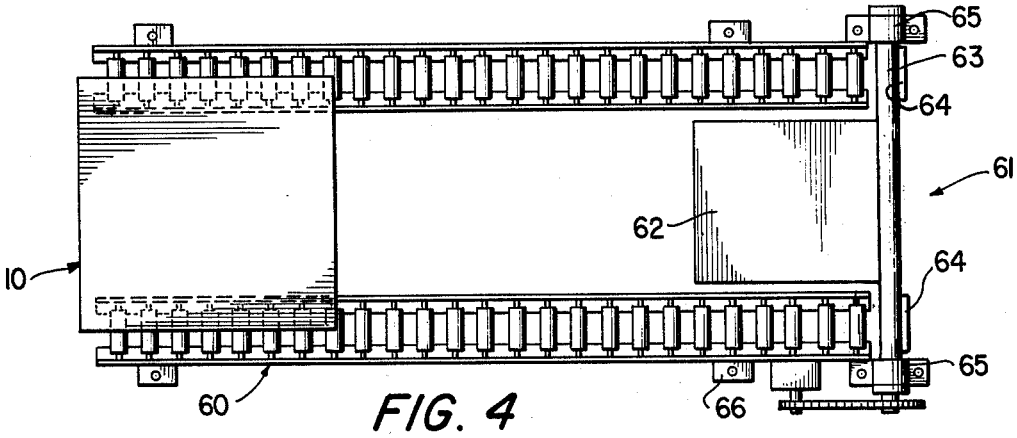
FIG. 4 is a top plan view of a conveyor with tilting mechanism for rotating a filled module by 90°.
Figure 5:
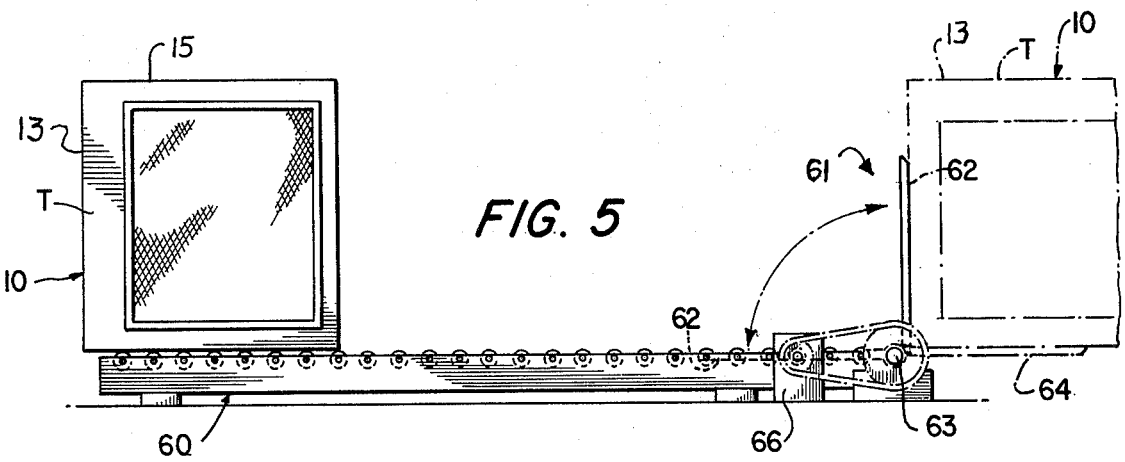
FIG. 5 is a side elevational view of the conveyor with the tilting mechanism.

FIGS. 4 and 5 illustrate a simple mechanism for aiding the above-mentioned operations. The fork-lift, as discussed, lifts the filled module from the transport unit and places the module 10 on a roller conveyor 60. The door 15 is installed and rods inserted. The module 10 is next rolled to the mechanical tilt device, shown generally at 61. This device rotates the closed module 90 degrees to permit lifting from the module bottom 21 with a fork lift. The tilt mechanism 61 includes a platform 62 connected rigidly to a main shaft 63 which has two forks 64 welded at right angles to platform 62. The main shaft 63 is mounted on bearings 65 with one end sprocket driven by a suitable gear motor 66. A hydraulic cylinder could similarly provide the necessary force for rotating the tilt mechanism.

With hand harvesting, the module 10 may be filled and packed by hand in the field, as on a trailer pulled behind a tractor in the skip row, or the leaves from various harvesting aid leaf conveyor belts may carry and drop the leaves directly into the containers. Another possible scheme is to hand pack the modules at the curing site, i.e. where the tobacco is brought to the curing facility in bulk or in small containers, sheets, sleds and the like. In any event, the module must be turned by 90° after filling and closure, and this preferably by tilt device 61, or other suitable means such as chain hoist.

Regardless of the method of loading the modules and regardless of the form of the tobacco loaded there into, it is desirable to obtain an optimum loading density. It will be recognized that the loading density of tobacco for modules will vary with the size and form of the tobacco material loaded therein. While a density of 14–20 lbs/ft$^3$ is considered to be optimum, a range of from 10–25 lbs/ft$^3$ would be functional.

Design and construction of the cross-flow modular curing system 70, which receives the modules 10 and provides conditioned air for complete curing and post-curing conditioning, are illustrated in reference to FIGS. 6–10. The curing system 70 includes preferably a concrete floor 71 upon which the remainder of the curing facility is constructed. Above the concrete floor 71, the curing system 70 includes side walls 72, a rear wall 73, a roof 74, an interior partition wall 75, a front gable wall 76, hinged front doors 77, an interior ceiling 87, and a heating-conditioning unit 78 along with certain dampers and duct openings to be described later. The side walls 72 may be constructed of readily available building materials, for example, framed with 2 × 4 inch studs and plates, covered with plywood on the interior surface, and covered with plywood or sheathing insultating board and metal siding on the exterior surface. The side walls 72 support only the structural frame of the building, hence economy of construction may be satisfactorily obtained by eliminating the interior surface of plywood; however, some suitable insulating board should be provided between the wall studs to conserve heat.

Figure 6:
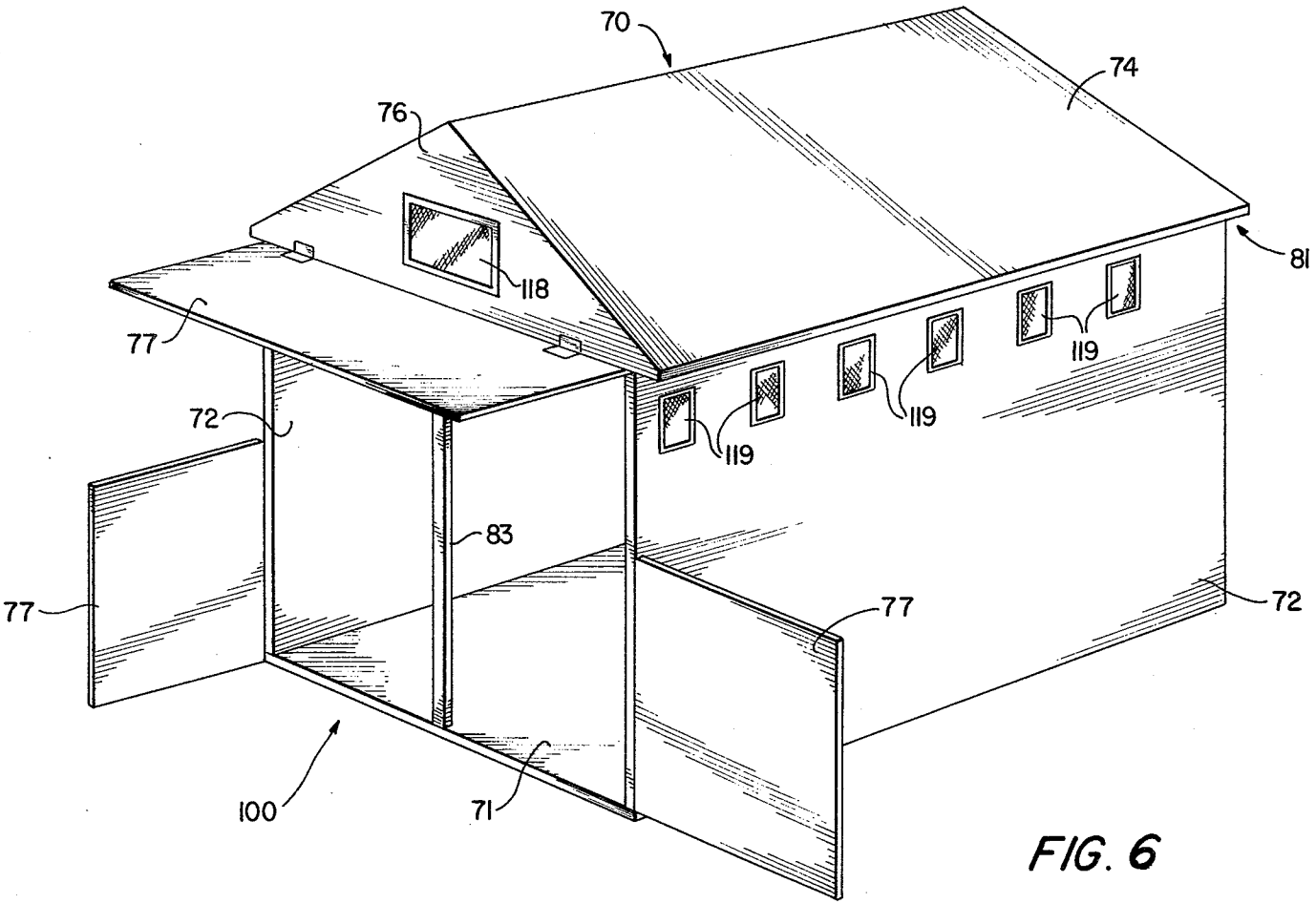
FIG. 6 is a perspective view of a cross-flow modular curing barn with the doors open.

The rear wall 73 is provided to protect the heating-conditioning unit 78 from weather and to form along with the interior wall 75 a suction plenum for inducing outside air 79 to move within the roof plenum 80 for pre-heating prior to entering the heating-conditioning unit 78. The rear wall 73 may be constructed the same as the side walls 72, and should include a door (not shown) for access to the heating-conditioning unit room 90. The roof 74 is of conventional construction including rafters, bracing and the like preferably covered with galvanized metal roofing, painted black or dark color to absorb solar energy. Preferably the gable wall is uninsulated, since heat transmission through the wall from outside to inside the roof plenum 80 will aid in improving the efficiency of the system. The interior partition wall 75 and the interior ceiling 87 serve to form a curing chamber shown generally at 100 for receiving the modules 10. Wall 75 is preferably constructed with 2 × 4 inch studs covered on both sides with plywood and should be insulated to prevent condensation on the wall surface during the high humidity phase of curing and to minimize heat loss. The ceiling 87 may be of plywood nailed to the ceiling joists 82. Insulation between the ceiling joists will aid in preventing condensation on the ceiling. Note should be given that the walls and ceiling of the curing chamber 100 should be tight to minimize air leakage. Hinged front doors 77 provide complete freedom of moving the curing modules 10 into and from the curing system 70. The top door is provided as shown in FIG. 6, since the curing system 70 as illustrated accommodates modules 10 stacked four high, which, with 4-ft. cubicals, would require an interior chamber height of at least 16 feet. A triple-door arrangement provides greater ease of closure and sealing than two extremely high doors. A center support post 83 provides a means for securing the doors 76 with tight seals. A suitable gasket material should be used to weatherstrip the doors to minimize air leakage.

Figure 7:
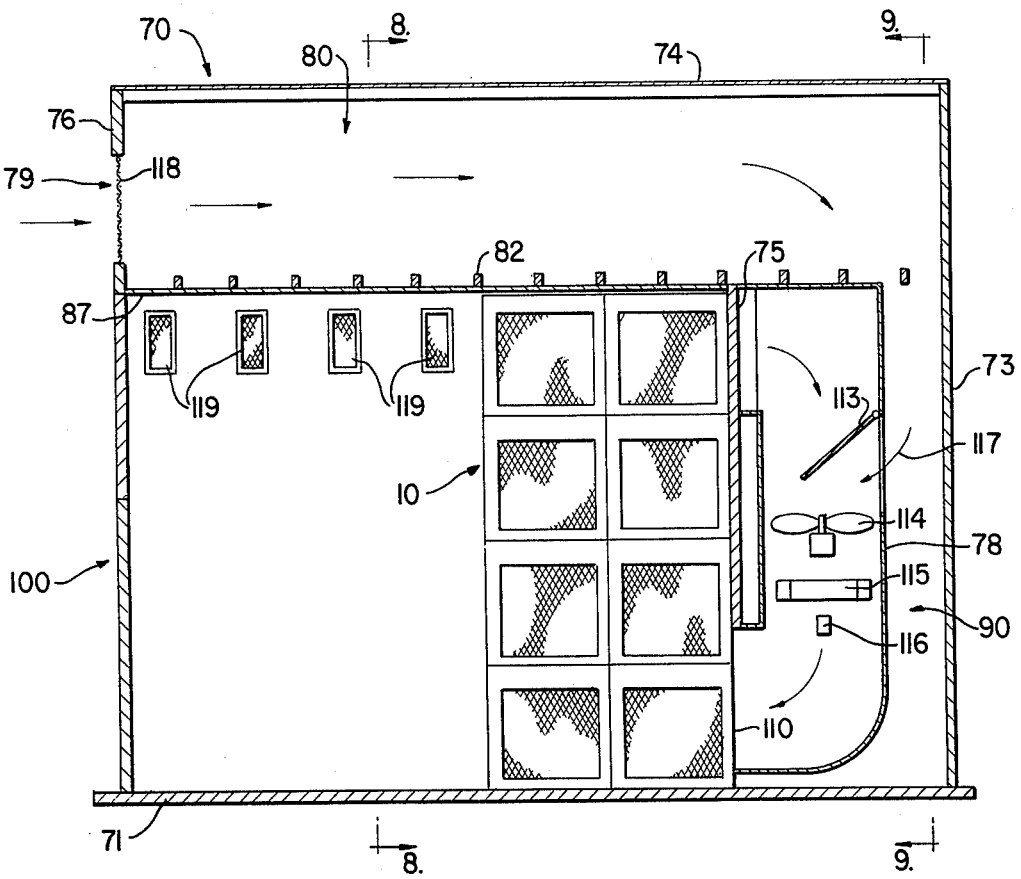
FIG. 7 is a longitudinal sectional view of the barn shown in FIG. 6.
Figure 8:
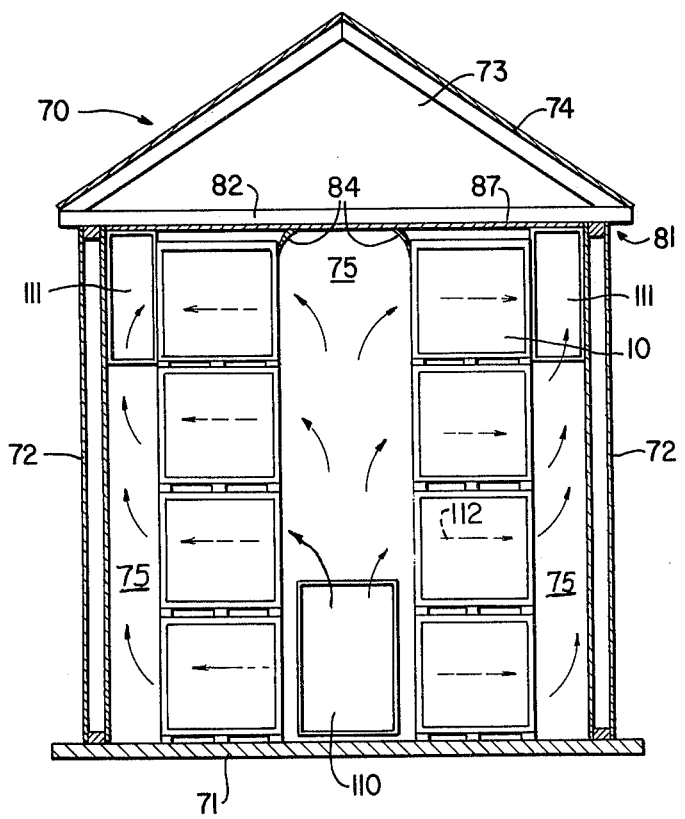
FIG. 8 is a sectional view on the line 8—8 of FIG. 7.
Figure 9:
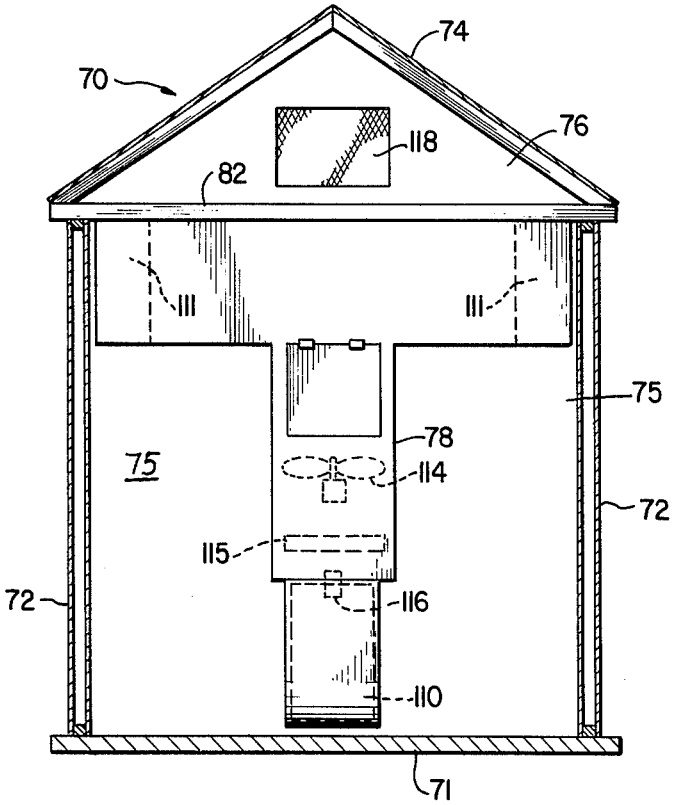
FIG. 9 is a sectional view on the line 9—9 of FIG. 7.
Figure 10:
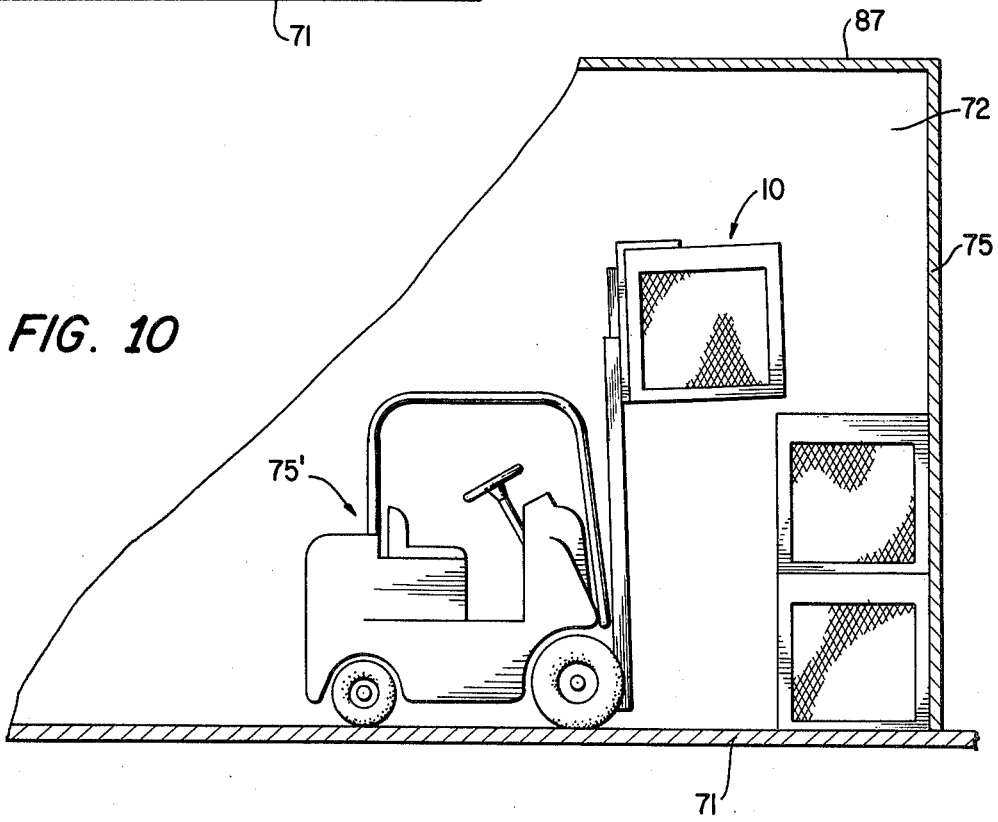
FIG. 10 is a side elevational view, partially schematic, illustrating fork lift handling and stacking of the cross-flow modules.

A fork lift 75' for handling of the modules 10 permits ease of loading and stacking filled containers in the curing chamber 100, as illustrated in FIG. 10. In the curing facility 70 illustrated in FIGS. 7 and 8, modules are stacked four high and in two rows. The first column of modules in each row is placed directly against the partition wall 75 to effect a tight seal. If necessary, a gasket material may be glued to the wall 75 to assure a tight fit. Similarly, the second and additional columns of modules are positioned, sealing against the previously formed column. As depicted in FIG. 7, the curing chamber 100 is designed to receive two rows of curing modules, 4 high, and 5 front to back, giving a total of 40 modules. When the two rows are completed, the front doors 77 are closed to seal with the last two columns of modules. This can easily be accomplished by compressible gasket material attached to the front doors 77. Complete sealing and formation of a central, high pressure inlet plenum is accomplished by means of the flexible strips 84 attached to the ceiling 87. Note should be made that by the manner of stacking and sealing, the space between the two rows of stacked modules becomes a high pressure plenum when air is introduced through air inlet 110. Similarly the two spaces formed between each row of stacked modules 10 and the side walls 72 of the curing facility 70 become the return or low pressure plenums. These high and low pressure plenums provide an exceptional degree of access for inspecting the progress of curing in any curing module 10. Preferably the high pressure plenum should be about 3-ft. wide and the low pressure plenum about 2-ft. wide. Air return outlets 111 to the heating-conditioning unit 78 are provided near the upper corners of the partition wall 75. Air is therefore forced horizontally through the perforate side walls 16, 17 of the curing modules 10, as illustrated by the arrows 112 of FIG. 12.

It is to be noted that this unique arrangement of stacking and formation of high and low pressue (inlet and return) plenums is accomplished without the necessity of special construction, thereby introducing further economy to the design. Furthermore, the cross-flow distance through the curing modules is maintained to a nominal level of 4 feet or less which has the effect of reducing air flow resistance and accelerating the cure. Stacking permits high capacity loading within the curing space and does not necessitate high cross-flow distances to achieve high capacity. By retaining nominal cross-flow distances of 4 feet or less, curing conditions are more uniform throughout the tobacco than in current bulk curing systems where air is forced upwardly or downwardly through depths of up to 6 or 7 feet. The hazard of rotting pathogens is also greatly reduced since drying throughout the modules 10 can take place earlier.

It is also of particular interest to note that heat loss from the central high pressure plenum is reduced in comparison with conventional bulk barn designs. This is due to the fact that heat dissipating surface area is reduced. Assuming a 3-ft wide central high pressure plenum, a cross-flow modular system 70 as described has 216 $ft^2$ of heat dissipating surface in the high pressure plenum compared with 977 $ft^2$ for typical bulk barns to cure an equivalent amount of tobacco. Furthermore, with the cross-flow design, air exiting from the modules 10 has been evaporatively cooled, thereby placing the "cooler" air next to the exterior walls 72 of the curing facility. This aids further in minimizing heat transfer through the walls of the curing facility.

Referring again to FIGS. 7–9, the specific modes of operation of the curing facility 70 will be described. After the facility is filled, the doors are closed and the heating-conditioning unit 78 energized. Air inlet damper 113 is normally closed to permit essentially complete recycling of the curing air, and the desired curing temperature is established by thermostatic control. The heating-conditioning unit 78 includes a fan 114, a suitable gas or oil-fired burner 115, and a water atomizer 116 (optional). Typically for curing of Virginia-type tobacco (flue-cured type), tobacco is yellowed for 36–72 hrs. at about 90°–100° F and 85 to 90% r.h. These conditions may be easily maintained thermostatically with either automatic or manual damper control.

In this case, air at regulated temperature is forced into the central plenum through air inlet 110 to develop a static pressure which produces cross-flow circulation through the tobacco in the curing modules 10 and the air is essentially recycled back to the heating-conditioning unit 78 by means of the air return outlets 111. A small quantity of fresh air, from roof plenum 80, may be introduced by opening the air inlet damper slightly if desired; or if automatically controlled the damper will adjust to maintain the preset conditions.

For leaf and stem drying, the air temperature introduced to the curing chamber 100 is normally gradually increased about 2°–4° F/hr until reaching 170° F. During this time, increasing amounts of fresh outside air are introduced to the heating-conditioning unit as shown by the arrow 117 in FIG. 7 when the air inlet damper 113 is opened. It is to be noted that by the design of the roof plenum 80 and gravity louver damper 118, fresh air is drawn through the roof plenum where it is preheated by solar energy (during the day period) and by conduction through the chamber ceiling 87 prior to reaching the inlet to the heating-conditioning unit 78. This further contributes to high efficiency of energy utilization by minimizing heat loss from the structure and the advantage of heat gain through the roof 74.

Under these conditions of curing, as the inlet damper 113 opens, it simultaneously blocks the return air from the curing chamber. This causes the static pressure in the return low pressure plenums near the walls 72 to increase above atmospheric pressure, forcing air to the outside through gravity louver dampers 119, which are located on both side walls 72 of the curing facility 70. As leaf and stem drying near completion, the inlet damper 113 is gradually closed to conserve energy. The total curing time is normally about 4 to 5 days.

Following drying, leaf conditioning to moisture contents of 16 to 18% is accomplished by adding known amounts of atomized water into the air stream (or by introducing humid outside air, if available).

Unloading of the cured tobacco is accomplished mechanically. The fork lift 120 removes the curing modules from the curing chamber 100 and places them outside where the rods or tines 38 are removed. The fork lift 120, equipped with a load inverter, then raises the module 10 and dumps the cured tobacco from the module 10 by tilting the container to the side having the hinged side screen door 29. The latch 28 is released and the contents of the module 10 transfer readily to a sheet or other suitable container used for packaging tobacco for market. Removal of the front door 15 of the module 10 is not required until the module is again ready for refilling with freshly harvested leaf.

The above description of the invention presents in detail the specific embodiments which lead to noted advances in technology of handling and curing tobacco. It is apparent that certain modifications in curing module construction or curing system layout may be made without altering the specific embodiments. For example, the curing module could include either none, one or two hinged perforate doors on the module sides. In regards to curing system layout, considerable latitude exists for size and capacity of the structure. One could provide also a layout with one row of modules stacked one or more high with the high pressure plenum on one side and the low on the other. Or, a system layout could be provided with more than two rows of stacked modules with alternate high and low pressure vertical plenums.

While the above description and operating procedures have been described for tobacco of the flue-cured type, it is apparent that the cross-flow modular tobacco curing system may be used for curing other tobaccos such as Burley, Maryland, cigar filler tobacco, Oriental, etc. by simple modification of curing schedules for temperature, humidity and air flow.

From the foregoing general and detailed description of the various embodiments of the invention, it will be seen that the aims and objects hereinbefore set forth and others are fully accomplished.

1. A method of curing or drying tobacco comprising;

a. placing tobacco to be cured in a container of rectangular solid configuration having gas impervious top and bottom walls, a pair of opposed generally impervious side walls and a pair of gas pervious opposed side walls;

b. supporting the tobacco in the containers by passing a plurality of rods therethrough with the axes of the rods parallel to the plane of the top and bottom walls;

c. stacking a plurality of the containers in a curing barn in at least one row with the row being spaced from a pair of opposed side walls of the barn to define a pair of isolated chambers between the opposed side walls of the barn and the air pervious side walls of the containers, and the chambers being generally coextensive with the row of containers;

d. directing a curing of drying gas stream into one of the isolated chambers; and e. withdrawing gas from the other of the isolated chambers whereby the curing gas stream flows generally horizontally and uniformly through the tobacco maintained in the containers of the row.

2. The invention defined in claim 1 wherein the plurality of quadrangular containers of rectangular solid configuration are stacked in a curing barn in at least a pair of spaced rows with each row being spaced from a wall of the curing barn to define with the walls of the barn at least three chambers having length and height demensions generally coextensive with the rows of containers; directing a curing or drying gas stream into the chamber between the pair of rows of containers; and withdrawing gas from the pair of chambers defined between the rows of containers and the walls of the curing barn whereby the curing gas stream flows generally horizontally and uniformly through the tobacco maintained in the pair of containers.

3. A tobacco curing or drying system comprising:

a. a barn having a floor, roof and side walls;

b. a transverse partition extending between a pair of opposed side walls and separating the interior of the barn into a curing or drying chamber and a gas conditioning chamber;

c. gas heating and gas moving means in the gas conditioning chamber;

d. a plurality of containers of rectangular solid configuration each having gas impervious top and bottom walls, a pair of generally gas impervious opposed side walls and a pair of gas pervious opposed side walls;

e. a plurality of rods extending between the pair of gas impervious side walls parallel to the top and bottom walls;

f. said plurality of containers being stacked in at least a pair of spaced rows in the curing or drying chamber with each row being spaced from a wall of the curing and drying chamber to define with the walls of the chamber gas outlet zones and said space between the pair of rows comprising a gas inlet zone; and g. means connecting the gas inlet zone and the pair of gas outlet zones with the gas outlet and inlet respectively of the gas moving means in the gas conditioning chamber.

4. The invention defined in claim 3 including gas flow control means communicating the ambient atmosphere with the pair of gas outlet zones in the curing or drying barn.

* * * * *